US006752902B2

(12) United States Patent
Heikkiläet al.

(10) Patent No.: US 6,752,902 B2
(45) Date of Patent: Jun. 22, 2004

(54) PREPARATION OF CHEMICAL PULP AND XYLOSE, UTILIZING A DIRECT ACID HYDROLYSIS ON THE PULP

(75) Inventors: Heikki Heikkilä, Espoo (FI); Mirja Lindroos, Kirkkonummi (FI); Jorma Sundquist, Espoo (FI); Seppo Kauliomäki, Espoo (FI); Raimo Rasimus, Lohja as (FI)

(73) Assignee: Danisco Sweeteners Oy, Espoo (FI)

( * ) Notice: Subject to any disclaimer, the term of this patent is extended or adjusted under 35 U.S.C. 154(b) by 166 days.

(21) Appl. No.: 10/046,967

(22) Filed: Jan. 14, 2002

(65) Prior Publication Data

US 2003/0037892 A1 Feb. 27, 2003

Related U.S. Application Data

(63) Continuation of application No. PCT/FI00/00645, filed on Jul. 13, 2000.

(51) Int. Cl.[7] ..... D21C 3/02; D21C 3/26; D21C 1/04; C13K 13/00; D21H 11/04

(52) U.S. Cl. ..... 162/17; 162/76; 162/90

(58) Field of Search ..... 162/17, 29, 30.11, 162/72, 76, 84, 90, 9; 536/123.1, 124, 123, 127, 128

(56) References Cited

U.S. PATENT DOCUMENTS

| | | | | |
|---|---|---|---|---|
| 3,954,497 | A | 5/1976 | Friese | |
| 4,008,285 | A | 2/1977 | Melaja et al. | |
| 4,070,232 | A | 1/1978 | Funk | |
| 4,734,162 | A | 3/1988 | Ampulski | |
| 6,440,547 | B1 * | 8/2002 | Luo et al. | 428/292.7 |
| 6,444,314 | B1 * | 9/2002 | Luo et al. | 428/393 |
| 6,471,727 | B2 * | 10/2002 | Luo et al. | 8/116.1 |
| 6,528,163 | B2 * | 3/2003 | Sealey et al. | 428/393 |
| 6,605,350 | B1 * | 8/2003 | Sealey et al. | 428/393 |
| 2001/0028955 | A1 * | 10/2001 | Luo et al. | 428/393 |
| 2002/0195213 | A1 * | 12/2002 | Izumi et al. | 162/55 |
| 2003/0037892 | A1 * | 2/2003 | Heikkila et al. | 162/17 |

FOREIGN PATENT DOCUMENTS

| | | | |
|---|---|---|---|
| FI | 55516 | 8/1979 | |
| WO | WO 98/56958 | 12/1998 | |
| WO | WO 200104362 A1 * | 1/2001 | C13K/13/00 |

OTHER PUBLICATIONS

Paice, M.G. and Jurasek, L., "Removing Hemicellulose From Pulps by Specific Enzymic Hydrolysis", *J. Wood Chem. And Tech.*, 4(2), pp. 187–198 (1984).

Guangyu, Yao et al., "Production of Pulp and Recovery of Xylose from Hardwood. II. The Optimal Process Conditions for Prehydrolysis of Eucalyptu Citriodora Chips with Dilute Sulphuric Acid and Sulfate Pulping", *Journal of Nanjing Technological College of Forest Products*, No. 4, p. 32 (1988).

STN International, file CAPLUS, CAPLUS accession No. 1980:550586, Document No. 93:150586, Kramar, Alojz et al., "Pentoses from beech bark"; and Czech. CS 181485 19800115, 3pp.

* cited by examiner

*Primary Examiner*—José A. Fortuna
(74) *Attorney, Agent, or Firm*—Scully, Scott, Murphy & Presser

(57) ABSTRACT

The invention relates to a method of preparing chemical pulp and xylose by the use of alkaline or neutral cooking and post hydrolysis of the pulp by performing the post hydrolysis directly on the pulp by means of acid treatment. In the method of the invention, the xylan in the pulp is utilized as completely as possible, resulting in a good xylose yield and, simultaneously, acceptable characteristics for the pulp.

25 Claims, No Drawings

PREPARATION OF CHEMICAL PULP AND XYLOSE, UTILIZING A DIRECT ACID HYDROLYSIS ON THE PULP

This is a Continuation of International Application No. PCT/FI00/00645 filed Jul. 13, 2000.

BACKGROUND OF THE INVENTION

The invention relates to the preparation of chemical pulp and xylose, and particularly to recovering xylose from pulp, such as sulphate pulp, prepared by alkaline or neutral cooking, and simultaneously achieving the desired characteristics for the pulp. The method of the invention utilizes a direct acid hydrolysis of the pulp, resulting in a good xylose yield. At the same time, the obtained pulp is usable as paper pulp or dissolving pulp.

In a plurality of plants, the main portion of hemicellulose is xylan, which can be hydrolyzed to xylose. The foremost starting material for xylan is hemicellulose from hardwood, particularly birch, mainly composed of xylan.

For example birch sulphate pulp typically contains about 15 to 25% xylan, which is usable as a raw material of xylose. When xylose is prepared from pulp, the problem involved has been to achieve sufficient xylose yields and to simultaneously achieve acceptable characteristics for the pulp.

Finnish Patent 55516 (Kemi Oy) discloses a method of preparing pure xylan, suitable for the raw material of xylose and xylitol, in particular. The method uses bleached or unbleached hardwood cellulose as the raw material. The cellulose is treated with an alkali solution, whereby the hemicelluloses are dissolved. The alkali solution containing hemicellulose is pressed and filtered from pulp. The dissolved hemicellulose is precipitated by the addition of carbon dioxide to the solution, whereby the xylan precipitates. In the method, most of the xylan in the pulp, the xylan being in principle usable as the raw material of xylose, is, however, not utilized. Moreover, the method uses much alkali.

Several methods are also known in which enzymatic hydrolysis is used to separate hemicellulose components from the pulp. For example Paice, M. G. & Jurasek, L., *Removing Hemicellulose from Pulps by Specific Enzymic Hydrolysis*, J. Wood Chem. and Tech., 4 (2), 187 to 198, 1984, describes a method of separating hemicellulose from aspen pulp by xylanase treatment. The most important hemicellulose products thus obtained were xylan and xylobiose. However, the enzyme dose is uneconomically large.

WO 98/56958 (Xyrofin Oy) discloses a method of preparing xylose by first extracting xylan from a cellulose pulp or its alkali solution with an aqueous solution of a xylanase enzyme and by then using acid to hydrolyze the xylan in the solution to xylose. However, the acid hydrolysis is not performed directly on the chemical pulp, and therefore all the xylan in the pulp cannot be utilized.

Acid hydrolysis is also applied as pre-hydrolysis in the separation of xylose from wood material. In this case, the acid hydrolysis is performed directly on wood chips before the pulp is prepared. One such method is disclosed in Guangyu, Yao et al., *Production of Pulp and Recovery of Xylose from Hardwood. II. The Optimal Process Conditions for Prehydrolysis of Eucalyptu Citriodora Chips with Dilute Sulphuric Acid and Sulfate Pulping*, Journal of Nanking Technological College of Forest Products, No. 4 (1988), p. 32. The publication relates to a method of preparing sulphate pulp with simultaneous recovery of xylose. As raw material is used Eucalyptu Citriodora chips, on which prehydrolysis is carried out with dilute sulphuric acid. A xylose-containing solution and prehydrolyzed wood chips are obtained. Sulphate pulp is then prepared from the prehydrolyzed wood chips. The pulp is said to be suitable for the preparation of viscose, for example.

U.S. Pat. No. 4,008,285 (Melaja, A. J. & Hämäläinen, L.) discloses a method of recovering xylitol from a xylan-containing raw material, which may be for example wood material, such as birch chips. The birch chips are first hydrolyzed with for example acid, the hydrolysate is purified and the purified hydrolysate is subjected to chromatographic fractionation to provide a solution containing a high level of xylose. However, the pulp is not recovered in this method.

BRIEF DESCRIPTION OF THE INVENTION

It is therefore an object of the invention to provide a method of recovering xylose from pulp prepared by alkaline or neutral cooking with a sufficient xylose yield, and, simultaneously, preparing paper pulp or dissolving pulp so as to obtain acceptable characteristics for the pulp. The objects of the invention are achieved by a method, which is characterized in what is disclosed in the independent claims. The preferred embodiments of the invention are disclosed in the dependent claims.

In accordance with the present invention, it has now been surprisingly found that high-quality paper pulp and dissolving pulp can be prepared by first subjecting the pulp to alkaline or neutral cooking and then, as post hydrolysis, to acid hydrolysis in order to recover the xylose. In the method of the invention, simultaneous extraction and hydrolysis of xylan are achieved, and extensive use of alkali in the extraction of xylan can be totally avoided.

In the context of the present invention, the expression 'sufficient xylose yield' refers to a xylose yield of at least 5% (50 g xylose/1,000 g pulp), preferably at least 10% (100 g xylose/1,000 g pulp), calculated on the dry substance of the pulp.

In the context of the present invention, the expression 'acceptable pulp characteristics' means that the viscosity of the acid-treated pulp remains sufficient for paper pulp or dissolving pulp. Typically, the viscosity of paper pulp or dissolving pulp should be at least 300 ml/g, preferably at least 450 ml/g, and most preferably at least 600 ml/g. The acceptable viscosity values depend on the final purpose of use of the pulp. If the pulp is used for the preparation of paper whose strength characteristics have to be good, a higher viscosity is required for the pulp, typically at least 600 ml/g. Pulp having a lower viscosity is feasible particularly when acid-treated pulp obtained by the method of the invention is used in a mixture with non-acid-treated pulp in the production of paper, for example.

The expression 'post hydrolysis is performed directly on the pulp' means that the acid treatment for hydrolyzing xylan to xylose is performed on the pulp itself, not for example on a xylan solution extracted from the pulp (such as in the method of WO 98/56958, for example). In this case, xylan is hydrolyzed into xylose in connection with the acid treatment of the pulp.

DETAILED DESCRIPTION OF THE INVENTION

The present invention relates to a method of preparing paper pulp or dissolving pulp and a xylose solution by the use of alkaline or neutral cooking and post hydrolysis of the pulp. The method is characterized in that the post hydrolysis is performed directly on the pulp by the use of an acid.

In the method of the invention, the pulp is typically post-hydrolyzed with an acid until the xylose yield is at least 5%, preferably at least 10%, while the viscosity of the pulp remains at a value of at least 300 ml/g, preferably 450 ml/g.

When the hydrolysis of xylan is performed directly on the pulp in connection with the acid treatment of the pulp without pre-treatment steps, the xylan contained by the pulp can be utilized as completely as possible. In this case the xylan can be hydrolyzed as efficiently as possible into xylose, and the xylose yields can be optimized.

In the present invention, alkali cooking refers to a sulphate process, soda process, soda/anthraquinone process and alkali sulphite process, and neutral cooking to a neutral sulphite process. Post hydrolysis is thus typically performed on pulp prepared by alkaline or neutral cooking, typically the sulphate process, the soda process, the soda/anthraquinone process, the alkali sulphite process or the neutral sulphite process. Sulphate pulp is the most preferably used.

In the cooking, hardwood or herbaceous plants can be used as the raw material. Examples of usable hardwood include birch, aspen, alder, oak, poplar, beech, gum tree and acacia tree. Especially important are birch and beech, for example. Examples of herbaceous plants include reed, reed canary grass, bagasse, bamboo and straw, such as corn straw.

An especially preferable raw material is birch, whereby acid hydrolysis is performed on birch sulphate pulp.

In the cooking, the pulp is cooked to the desired kappa number, which is typically in the range between 20 and 40. After the cooking, the pulp may be further subjected to oxygen delignification (to a kappa number of about 10, for example) and bleaching (typically to a kappa number of about 0).

The acid hydrolysis can be performed immediately after the cooking, oxygen delignification or bleaching (ECF bleaching, for example).

In order to make the xylan hydrolyze as efficiently as possible to xylose, the pulps can be subjected to liquor exchange before the acid treatment, whereby the solution affecting the pulp is as close as possible to the adjusted concentration. In liquor exchange, the aqueous solution contained by the pulp is replaced by the acid to be used, for example by concentrated formic acid. The liquor exchange can also be carried out by evaporating the water contained by the pulp and replacing it with the acid to be used in the acid treatment.

In the acid treatment, xylose is preferably recovered in monomer form. However, xylose can also be recovered in oligomer form.

The acid treatment can be carried out with a mineral acid or an organic acid.

The acid treatment is preferably carried out with formic acid. The concentration of the formic acid solution is typically in the range between 50 and 100%, preferably between 75 and 90%. The treatment temperature is typically between 90 and 130° C., preferably between 100 and 120° C. The duration of the formic acid treatment is typically from 15 min to 4 h, preferably from 20 min to 1.5 h.

The acid treatment can also be carried out with for example a bisulphite solution, which is usually readily available in sulphate pulp processes. In the present invention, a bisulphite solution refers to a partly neutralized aqueous solution of sulphur dioxide ($SO_2$) containing bisulphite ions. The $SO_2$ content of the bisulphite solution is typically in the range of about 1 to 5%, preferably about 3%, of which the amount of bound $SO_2$ is typically about 10%. When a bisulphite solution is used, the acid treatment temperature is typically about 110 to 150° C., preferably about 125 to 145° C. The duration of the bisulphite treatment is typically about 1 to 3 h.

Other usable acids include sulphuric acid, sulphurous acid and hydrochloric acid.

The treatment with formic acid is preferably carried out after bleaching (for example ECF bleaching), but it also can be carried out after oxygen delignification, or even immediately after cooking, on unbleached pulp.

The treatment with bisulphite solution is preferably carried out before oxygen delignification/bleaching, but can also be carried out after oxygen delignification or bleaching, for example ECF bleaching.

After the acid treatment, the pulp is typically washed to recover the xylose as completely as possible from the acid-treated pulp.

After the acid treatment, the obtained xylose solution and the pulp are separated, typically by filtration. The acid used, for example formic acid, is then separated from the xylose solution, typically by distillation. The separated acid is recycled and reused in hydrolysis.

The obtained xylose solution is usable for the preparation of xylose. From the xylose, xylitol can be further prepared by catalytic reduction, for example.

The xylose is usable as such, for example as a flavour and an aroma intensifier. The xylitol is usable as a special sweetener, for example.

The paper pulp or dissolving pulp obtained from the acid treatment is recovered. The pulp thus obtained is usable, when bleached, for the preparation of paper and viscose, either as such or in combination with non-acid-treated pulp.

The invention also relates to a xylose solution and to a pulp product obtained by the method and to xylose obtained from the xylose solution. The invention also relates to the use of the xylose solution thus obtained for the preparation of xylose and xylitol, and to the use of the obtained paper pulp and dissolving pulp for the preparation of paper or viscose. The invention also relates to the use of the xylose thus obtained for the preparation of flavours and/or aroma intensifiers.

The following detailed examples illustrate the present invention.

In the examples, the kappa number, viscosity, pulp yield (on dry substance of the pulp) and brightness were determined by the following methods:

Kappa number SCAN-C 1:77

Viscosity SCAN-CM 15:88

Pulp yield (on dry substance of the pulp) SCAN-C 3:78

Brightness SCAN-C 11:75.

The xylose yields (as % of dry substance of the pulp) were calculated by means of the xylose content analyzed from the cooking liquor by HPLC and by the consistency of the cooking.

EXAMPLE 1

Treatment of Birch Sulphate Pulp with Formic Acid

The object was to hydrolyze xylan in birch sulphate pulp to xylose by acid treatment with a sufficient yield (>50 g xylose/1 kg starting pulp) so that the birch pulp would be suitable for dissolving pulp or paper pulp after the acid treatment. The target was a xylose yield of no less than about 5% and a viscosity of the acid-treated pulp that would be sufficient for either paper pulp or dissolving pulp.

In order for the hydrolysis to take place as efficiently as possible, the pulps were subjected to liquor exchange before the acid hydrolysis by replacing the water contained by the pulp with the acid solution to be used.

(A) Birch sulphate pulp was hydrolyzed by commercial formic acid (85%) as the acid solution. The treatment times were 20 min and 80 min. The treatment temperatures were 107° C. and 115° C. The pulp used was unbleached (kappa number 18.0, brightness 30.5 and viscosity 1210 ml/g), oxygen delignified (kappa number 11.3, brightness 45.0 and viscosity 1020 ml/g) or ECF bleached (kappa number 0.6, brightness 89.0 and viscosity 890 ml/g). Table 1 shows pulp yield (%), pulp viscosity ($cm^3/g$), xylose yield from starting pulp (g/kg starting pulp) and theoretical yield of xylose (%).

TABLE 1

Formic acid treatment of birch sulphate pulp

| A | B | C | D | E | F | H |
|---|---|---|---|---|---|---|
| 7 | kosa | 107 | 20 | 93.2 | 1010 | 25.9 |
| 8 | kosa | 107 | 80 | 84.1 | 610 | 53.2 |
| 19 | kosa | 115 | 20 | 83.4 | 530 | 63.8 |
| 20 | kosa | 115 | 80 | 76.1 | 430 | 77.1 |
| 9 | kosa-O | 107 | 20 | 95 | 840 | 19.5 |
| 10 | kosa-O | 107 | 80 | 86.4 | 500 | 69.1 |
| 21 | kosa-O | 115 | 20 | 85.6 | 460 | 59.2 |
| 22 | kosa-O | 115 | 80 | 77.8 | 380 | 70.1 |
| 12 | ECF | 107 | 80 | 89.7 | 390 | 46.5 |
| 23 | ECF | 115 | 20 | 89.3 | 360 | 46.5 |
| 24 | ECF | 115 | 80 | 79.7 | 300 | 74.5 |

Specifications
A = Test number
B = Pulp quality
Kosa = unbleached pulp
Kosa-O = oxygen delignified pulp
ECF = ECF bleached pulp
C = Treatment temperature ° C.
D = Treatment time min.
E = Pulp yield % (after extraction)
F = Pulp viscosity, $cm^3/g$
G = Xylose yield, g/kg starting pulp
H = Xylose yield on theoretical, %

(B) Unbleached birch sulphate is hydrolyzed by an acid solution having a formic acid content of 54%. The treatment temperature is 107° C. and treatment time 25 min. The viscosity of the obtained pulp is 1,000 ml/g. The carbon hydrate yield is 19.3% of the theoretical hemicellulose amount (46.2 g/kg pulp), of which 93.4% is xylose, i.e. 43.2 g/kg starting pulp (18% of the theoretical xylose yield).

(C) ECF bleached birch sulphate pulp is hydrolyzed by an acid solution having a formic acid content of 78%, treatment temperature 107° C. and treatment time 50 min. The viscosity of the obtained pulp is 600 ml/g. The carbon hydrate yield is 28% of the theoretical hemicellulose amount (67.1 g/kg), of which 92.5% is xylose, i.e. 62.1 g/kg starting pulp.

The tests conducted showed that the most preferable way to recover sugars with formic acid is from fully ECF bleached birch sulphate. At a maximum, from the pulps treated, about 185 g/kg xylose was obtained from non-bleached birch sulphate, 168 g/kg from oxygen treated birch sulphate, and about 179 g/kg from fully bleached birch sulphate.

EXAMPLE 2

Treatment of Birch Sulphate Pulp with Formic Acid

Oxygen delignified birch sulphate pulp was hydrolyzed with commercial formic acid (85%) at a temperature of 107° C., the treatment times varying between 43 and 60 min. The following results were obtained:

average pulp yield 89.4% (range of variation 88.4 to 90.4%);

average pulp viscosity 650 ml/g (range of variation 600 to 710 ml/g);

average xylose yield from starting pulp 82.6 kg/1,000 kg pulp.

For the preparation of paper, the pulp was bleached with both ECF-(D-Eop-D) and TCF-(Q-P-Z/Q-P) sequences, whereby the final brightness of the ECF bleached pulp was 90.9 and that of the TCF bleached pulp 85.1.

The pulp thus obtained can be combined with non-acid-treated pulp and used for the preparation of fine paper.

EXAMPLE 3

Treatment of Birch Sulphate Pulp with Formic Acid and Preparation of Viscose

ECF bleached birch sulphate pulp was hydrolyzed with commercial formic acid (85%) at 107° C. for 50 minutes, whereby the following results were obtained:

pulp yield 93.9% pulp viscosity 470 ml/g xylose yield from starting pulp 78.8 kg/1,000 kg.

The pulp thus treated was washed and used as such for the preparation of viscose. The viscose was prepared as follows:

Mercerization was carried out as slurry mercerization by elutriating chemical pulp in 18.0% (w/w) NaOH solution at 50° C. for 20 minutes (doses 42.5 g chemical pulp/1 liter NaOH solution).

After mercerization, the alkali cellulose was filtered from the slurry so as to form a cake, which was hydraulically pressed to a suitable dry substance content. The obtained contents of the alkali cellulose were: 32.14% alpha cellulose and 15.11% NaOH. These values corresponded to normal values. The pressed cake was torn in a mixer so as to obtain flaky pulp, which was prematured for 22 hours at 34° C. to obtain a suitable DP level.

To the prematured alkali cellulose, 35% carbon bisulphide of the alpha cellulose content of the alkali cellulose was added under reduced pressure. The sulphuring was carried out at 32° C. during 1 h 15 min.

The cellulose xanthate generated in the sulphuring was dissolved with a dilute NaOH solution during 4 hours at 20° C. The water and NaOH amounts in the NaOH solution were adjusted such that the viscose contents obtained were 6% NaOH and 8% alpha cellulose.

The dissolved viscose was post-matured for 24 hours at 20° C., whereupon the ball viscosity and the drainability were measured from the viscose.

The ball viscosity of the thus obtained viscose (i.e. the time required for a steel ball having a 3-mm diameter to sink a 20-cm distance in a viscose solution) was 37.5 seconds, i.e. the viscose was relatively fluid.

EXAMPLE 4

Treatment of Birch Sulphate Pulp with Bisulphite Solution

Unbleached birch sulphate pulp was hydrolyzed with an aqueous solution of bisulphite. The purpose was to hydrolyze xylan from the pulp into xylose with a good yield and simultaneously retain the paper production properties of the pulp as good as possible. The target yield of xylose was 5% or more. The viscosity of the pulp was used as the measure of the paper production properties, and the target viscosity was set to be not less than 450 ml/g.

The treated pulp was then bleached to the target brightness of 85 ISO or 90 ISO.

The raw material used was conventional birch sulphate pulp. The pulp had the following characteristics:

| | |
|---|---|
| total yield, % | 51.8 |
| screening yield, % | 50.4 |
| reject, % | 1.4 |
| kappa number | 20.6 |
| viscosity, ml/g | 1350 |
| brightness, ISO | 26.9 |

A sulphite cooking liquor was used in the hydrolysis. The total $SO_2$ content of the solution was 3%, of which 10% was bound $SO_2$. The binding cation was Na+.

The hydrolysis was carried out in an acid-resistant steel autoclave having a volume of 1 $dm^3$. The pulp and the sulphite cooking liquor were heated in an air bath starting from room temperature up to the final treatment temperature (130 or 140° C.), the duration of the reaction being 1 to 3 h.

After the hydrolysis, the autoclave was cooled to room temperature. The hydrolysis solution was filtered from the mixture with a vacuum filter, and the xylose content of the solution was measured.

The pulp was washed with water. The washing water was filtered from the mixture and the pulp was centrifuged and homogenized. The yield, viscosity, kappa number and brightness of the pulp were measured. The results are shown in Table 2.

TABLE 2

Treatment of birch sulphate pulp with bisulphite

| Test | Temperature, ° C. | Time, min | Bound $SO_2$, % | Pulp yield, % | Xylose yield, % | Viscosity, ml/g | Kappa number | Brightness % |
|---|---|---|---|---|---|---|---|---|
| 8 | 140 | 120 | 10 | 87.3 | | 570 | | 48.5 |
| 9 | 140 | 180 | 10 | 84.7 | | 490 | | 47.3 |
| 10 | 130 | 60 | 10 | 92.1 | | 810 | | 46.4 |
| 11 | 130 | 120 | 10 | 90.4 | 4.4 | 670 | 9.7 | 46.8 |
| 12 | 130 | 180 | 0 | 89.0 | | 620 | 9.2 | 47.7 |
| 15 | 130 | 180 | 10 | 89.6 | 5.3 | 630 | 8.9 | 47.2 |
| 16 | 130 | 120 | 10 | 90.7 | | 710 | 9.2 | 46.5 |

The yield values of the pulps show that sufficient amounts of xylose were separated from the pulp, i.e. the xylose yields approximately corresponded to the target values, as did the viscosity values. In tests 11 and 15, xylose yields (as % of dry substance of the pulp) were also separately determined. The results confirmed that the xylose yields approximately correspond to the target values.

The pulps obtained from tests 15 and 16 were combined and bleached with the sequence $O_p$—D—P to the target brightness.

It is obvious to a person skilled in the art that as technology advances, the basis idea of the invention can be implemented in a variety of ways. Accordingly, the invention and its embodiments are not limited to the above-described example, but may vary within the scope of the claims. Consequently, in addition to birch sulphate pulp, the method can be applied to other hardwood pulp prepared by alkaline or neutral cooking or to pulp prepared from herbaceous plants. In the post hydrolysis, other organic or inorganic acids besides formic acid and a bisulphite solution may also be used.

What is claimed is:

1. A method of preparing chemical pulp and a xylose solution by the use of alkaline or neutral cooking and a post hydrolysis of the pulp, wherein the post hydrolysis is preformed directly on the pulp by the use of an acid by post-hydrolyzing the pulp with an acid until a xylose yield of no less than 5% is obtained, while the viscosity of the pulp remains at a value of no less than 300 ml/g, followed by the recovery of chemical pulp and a xylose solution.

2. The method as claimed in claim 1, wherein the pulp is post-hydrolyzed with an acid until a xylose yield of no less than 10% is obtained, while the viscosity of the pulp remains at a value of no less than 450 ml/g.

3. The method as claimed in claim 1, wherein the acid treatment is carried out with formic acid.

4. The method as claimed in claim 3, wherein the content of the acid solution is within the range of 50 to 100%.

5. The method as claimed in claim 3, wherein the content of the acid solution is within the range 75 to 90%.

6. The method as claimed in claim 3, wherein the acid treatment temperature is between 90 to 130° C.

7. The method as claimed in claim 3, wherein the acid treatment temperature is between 100 to 120° C.

8. The method as claimed in claim 3, wherein the duration of the acid treatment is between 15 min and 4 h.

9. The method as claimed in claim 3, wherein the duration of the acid treatment is between 20 mm and 1.5 h.

10. The method as claimed in claim 1, wherein the acid treatment is performed with a bisulphite solution.

11. The method as claimed in claim 10, wherein the $SO_2$ content of the bisulphite solution is within the range from about 1 to about 5%.

12. The method as claimed in claim 11, wherein amount of bound $SO_2$ is about 10%.

13. The method as claimed in claim 10, wherein the $SO_2$ content of the bisulphite solution is about 3%.

14. The method as claimed in claim 10, wherein the acid treatment temperature is about 110 to 150° C.

15. The method as claimed in claim 10, wherein the acid treatment temperature is about 125 to 145° C.

16. The method as claimed in claim 10, wherein the duration of the acid treatment is 1 to 3 h.

17. The method as claimed in claim 1, wherein the acid treatment is performed after cooking.

18. The method as claimed in claim 1, wherein the acid treatment is performed after oxygen delignification.

19. The method as claimed in claim 1, wherein the acid treatment is performed after bleaching.

20. The method as claimed in claim 1, wherein the cooking is performed by the sulphate method, whereby the post hydrolysis is carried out directly on the pulp by the use of an acid.

21. The method as claimed in claim 1, wherein birch is used as the raw material in the cooking.

22. The method as claimed in claim 21, wherein the acid used in the acid treatment is separated from the obtained xylose solution.

23. The method as claimed in claim 1, wherein after the acid treatment the obtained xylose solution and the chemical pulp are separated.

24. The method as claimed in claim 23, wherein the separated acid is recycled and reused in the hydrolysis.

25. The method as claimed in claim 1, wherein the obtained chemical pulp is mixed with non-acid-treated pulp.

* * * * *